US007661873B2

(12) United States Patent
Gandini et al.

(10) Patent No.: US 7,661,873 B2
(45) Date of Patent: Feb. 16, 2010

(54) HOMOGENISER FOR THE CONTINUOUS TREATMENT OF FLUIDS AT VERY HIGH PRESSURE

(75) Inventors: Marco Gandini, Parma (IT); Simone Grandi, Sala Baganza (IT)

(73) Assignee: Niro-Sovai S.p.A., Parma (IT)

( * ) Notice: Subject to any disclaimer, the term of this patent is extended or adjusted under 35 U.S.C. 154(b) by 560 days.

(21) Appl. No.: 10/594,362

(22) PCT Filed: Sep. 1, 2004

(86) PCT No.: PCT/IB2004/051643

§ 371 (c)(1),
(2), (4) Date: Sep. 26, 2006

(87) PCT Pub. No.: WO2005/097308

PCT Pub. Date: Oct. 20, 2005

(65) Prior Publication Data

US 2008/0232189 A1 Sep. 25, 2008

(30) Foreign Application Priority Data

Apr. 9, 2004 (IT) ..... PR2004A0031

(51) Int. Cl.
*B01F 5/12* (2006.01)

(52) U.S. Cl. ..... 366/176.3; 366/267

(58) Field of Classification Search ..... 366/267, 366/176.1, 176.2, 176.3, 176.4; 417/490, 417/540, 568
See application file for complete search history.

(56) References Cited

U.S. PATENT DOCUMENTS 3,707,864 A * 1/1973 Pigott et al. ..... 72/60
4,233,886 A 11/1980 Balzano et al.
5,579,682 A * 12/1996 Bergman et al. ..... 366/267
6,162,031 A 12/2000 Tremoulet, Jr.
6,305,265 B1 10/2001 Bingham et al.

FOREIGN PATENT DOCUMENTS

EP 1 284 367 A1 2/2003

* cited by examiner

*Primary Examiner*—Tony G Soohoo
(74) *Attorney, Agent, or Firm*—Ladas & Parry LLP

(57) ABSTRACT

A homogeniser (1) for the continuous treatment of fluids at very high pressure comprises at least one reciprocating plunger (5) in a compression chamber (6) and a guide chamber (11) from a fluid intake position to a delivery position. Said compression chamber (6) opens into a manifold (27), inside a block (26) from which a delivery pipe (32) and an intake pipe (31) branch off. A first seal unit (21) is housed in the guide chamber (11), a second seal unit (24) is located close to the intersection between the compression chamber (6) and the guide chamber (11) and a third seal unit (35) is positioned upstream and downstream of each valve (28, 29) and the intersection between the manifold (27) and the compression chamber (6).

22 Claims, 4 Drawing Sheets

HOMOGENISER FOR THE CONTINUOUS TREATMENT OF FLUIDS AT VERY HIGH PRESSURE

TECHNICAL FIELD AND BACKGROUND ART

The present invention relates to a homogeniser for the continuous treatment of fluids at very high pressure.

Said apparatus, consisting of a plunger pump and of one or more homogenising valves installed in series on the delivery manifold, is applied in sectors such as the food, pharmaceuticals, cosmetics, and chemical industries and is used more generally for cell breakage treatment of fluids, that is to say for biological products such as vaccines, therapeutic substances and enzymatic and diagnostic preparations.

The objective of all cell breakage techniques, using predetermined apparatuses and/or chemical substances, is to achieve productive cell disaggregation, that is to say which destroys any polluting cells, and at the same time is able to liberate any subcellular substances useful for subsequent production processes.

The use of a high pressure homogeniser, which is normal in mechanical cell breakage techniques, takes advantage of the forced passage from a high pressure zone to a low pressure zone, causing said controlled cellular disaggregation of the fluid treated, using an adjustable valve, commonly known as a homogenising valve, applied on the plunger pump delivery side to generate the pressure required.

PR99A000045 by the same Applicant describes a pump for the treatment of fluids at high pressure comprising a reciprocating plunger in a compression chamber from a fluid intake position to a fluid delivery position; a block for each plunger, connecting the pumping chamber to the intake and delivery valves housed in lateral containers fixed to the block. Each block comprises two half-parts or plates clamped together and having internal grooves to house an internal manifold which connects the pumping chamber and the intake and delivery valves.

The prior art comprises various different types of pumps and therefore homogenisers able to operate at pressures which range from around 500 bar to a maximum of 1500 bar. Studies of said apparatuses have focused on a gradual increase in the operating pressure.

Over the years such homogenisers have evolved to provide a continuous increase in the operating pressures, focusing on both the search for a type and configuration of internal pipes eliminating all variations in cross-section, intersection between holes and internal edges, and on the search for special materials characterised by greater resistance to the stresses to which the pipes and in particular their intersections are subjected.

Initial studies allowed the development of increasingly high operating pressures, up to a maximum of 1500 bar, but research on the quality of the materials was abandoned on account of the impact that they would have had on the final cost of the machine, limiting its commercial scope. By means of computational fluid simulations followed by laboratory tests, the Applicant analysed the assembly consisting of the compression chamber, intake pipe and delivery pipe, the pump and the homogenising valve which together form a high pressure homogeniser.

The Applicant's studies and experiments allowed the identification of the geometrical set up and the technical measures to be applied to the type of machine previously described in order to obtain a prototype able to operate at pressure values that are almost tripled.

DISCLOSURE OF THE INVENTION

The aim of the present invention is to provide a homogeniser with a configuration which allows it to reach pressures of up to 4000 bar, the materials used to construct the part subject to the processed fluid pressure being the same.

Another aim of the present invention is to provide a homogeniser able to operate at up to 4000 bar without increasing its production costs for the maker and maintenance costs for the end user.

Said aims are fulfilled by the machine disclosed, as described in the claims herein.

In particular, the homogenizer consists of a pump part comprising at least one reciprocating plunger in a compression chamber between a fluid intake position and a fluid delivery position; a block for each plunger, connecting the compression chamber to the intake and delivery valves housed in containers preferably having a cylindrical shape connected to the upper and lower parts of the block by removable connecting systems such as stud bolts; an internal manifold connecting the compression chamber to the intake and delivery valves, the homogeniser being characterised in that, close to the manifold, the plunger has a dynamic self-energising seal system acting on its cylindrical surface, and in that upstream and downstream of each valve, and downstream of the manifold where the manifold intersects with the compression chamber, and generally in the connections between the various component parts of the assembly, there are static seal systems consisting of an anti-extrusion ring in which a self-energising seal with the appropriate geometry and profile is inserted.

The delivery valve units, if more than one, there always being the same number as the plungers, are connected to one another by a delivery manifold which receives the flow of pressurised liquid from each compression chamber. Similarly, the equivalent intake valve units, if more than one, are connected to one another by an intake manifold, and there may be a support flange for each intake valve unit inserted between them.

BEST MODE FOR CARRYING OUT THE INVENTION

This and other characteristics are more clearly illustrated in the description which follows, with reference to the accompanying drawing, which illustrate a preferred embodiment without limiting the scope of application, and in which.

Figure 1:
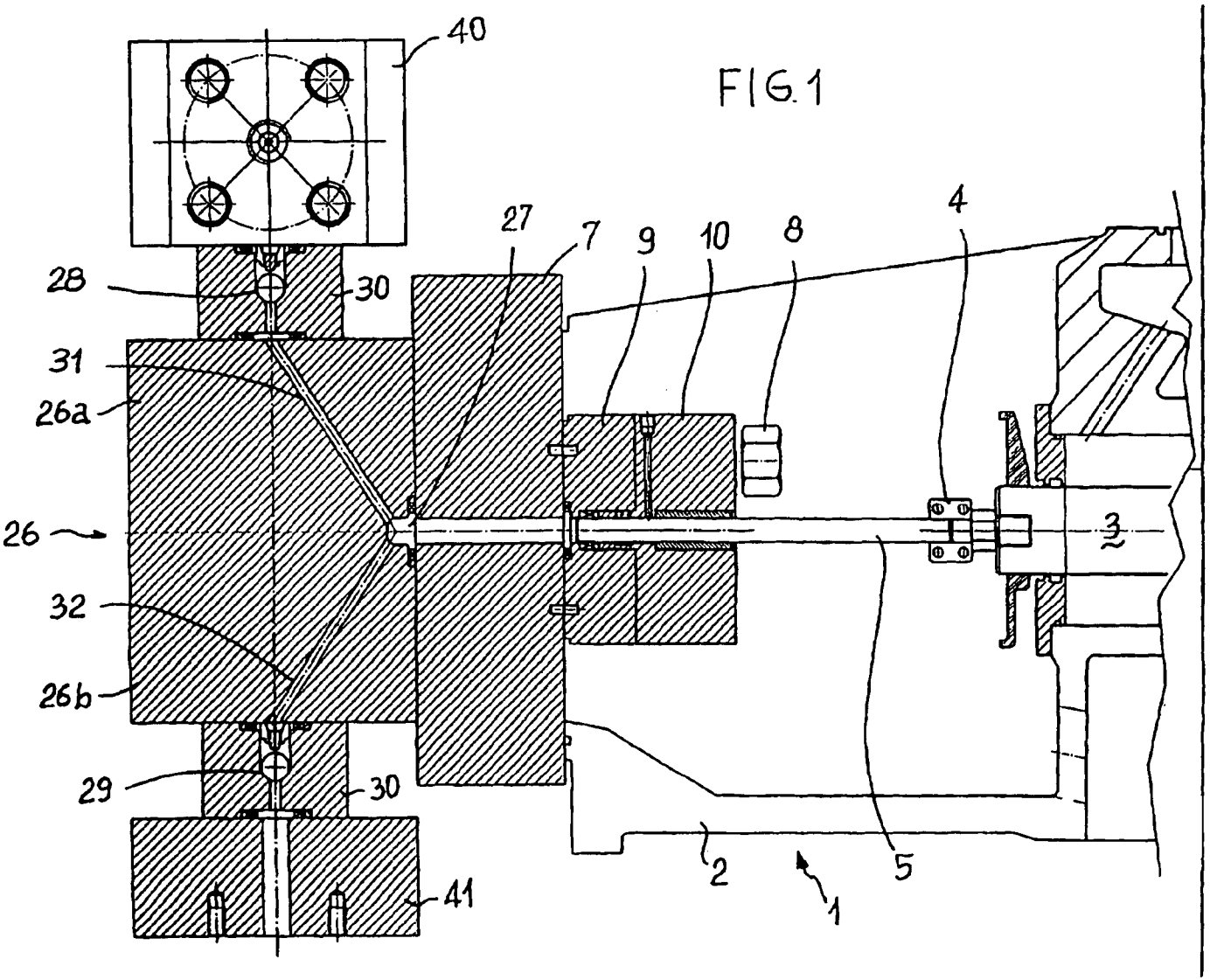
FIG. 1 is a side view and cross-section at mid length of the pump part of the homogeniser.

With reference to the accompanying drawings, the numeral 1 denotes as a whole a homogeniser whose body 2 houses a cross-head guide piston 3, driven in a substantially known way, to the end of which a clamp 4 fixes a reciprocating plunger 5 in a compression chamber or cylinder 6.

The plunger 5 is preferably made of a ceramic material such as pure silicon nitride $Si_3N_4$.

Figure 2:
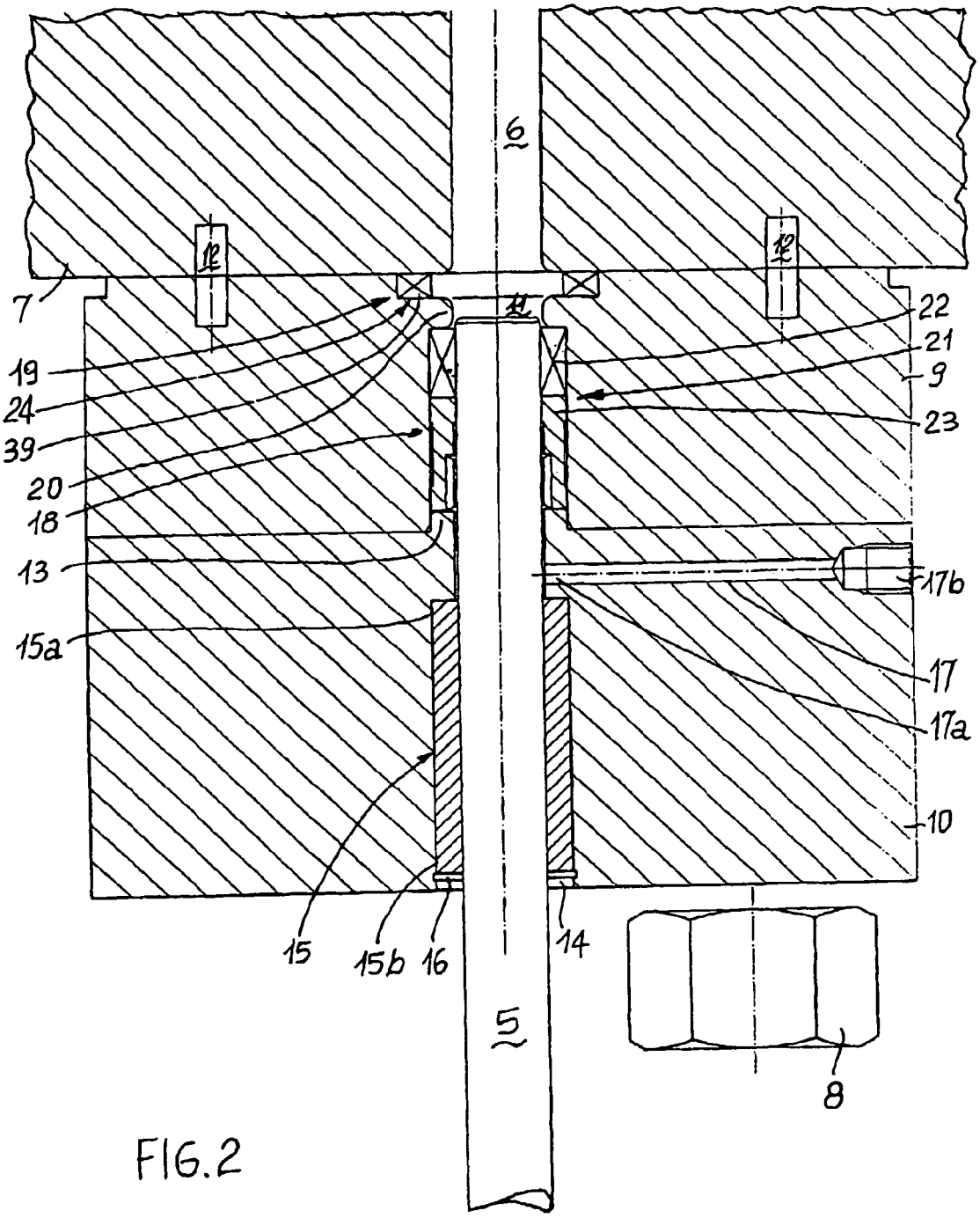
FIG. 2 is a side view and enlarged cross-section at mid length of the guide chamber for the single-acting reciprocating plunger.

The compression chamber 6 is formed inside a first block 7 to which stud bolts 8 fix a housing flange 9 and a locking flange 10, the latter both preferably cylindrical and between them forming a guide chamber 11 for the plunger 5 coaxial with the compression chamber 6 (FIG. 2).

To prevent problems with the coaxial alignment between the compression chamber 6 and the guide chamber 11 for the plunger 5, and at the same time to facilitate assembly in sequence on the block 7 first of the housing flange 9 then the locking flange 10, the block 7 and the housing flange 9 have, on their surfaces which face one another, a plurality of cylindrical connecting and centring pins 12, whilst the locking flange 10 has, on the surface facing the housing flange 9 a projection 13 having the shape of a truncated cylinder designed to fit into a recess in the surface of the housing flange 9.

Inside the locking flange 10 there is a seat 14, formed by a widening of the cross-section of the guide chamber 11 hole, for housing a guide bushing 15 for the plunger 5, made of self-lubricating plastic material, preferably PEEK, and having one end 15*a* in contact with the widening of the cross-section of the guide chamber 11 hole and the opposite end 15*b* clamped by an elastic stop ring 16. Said guide bushing 15 is preferably characterised by two or more longitudinal cuts designed to reduce the contact surface between the bushing 15 and the plunger 5 to limit friction and allow evacuation of the lubricating liquid used from a lubricating liquid feed pipe 17, present on the locking flange 10 and preferably angled so that it is perpendicular to a horizontal plane passing through the axis of the guide chamber 11 and parallel with the surface of the locking flange 10 in contact with the housing flange 9.

Said lubricating pipe 17, supplied with water or another type of liquid or emulsion, has one end 17*a* opening into the plunger 5 guide chamber 11 and the opposite end 17*b* terminating on the side wall of the locking flange 10. Inside the housing flange 9, along the hole forming the guide chamber 11, there is a first widening of the cross-section 18 and a second widening of the cross-section 19, separated from one another by a shoulder 20.

The first widening of the cross-section 18 involves the insertion of a first dynamic seal unit 21 acting on the surface of the reciprocating plunger 5, having a first self-energising seal 22, preferably shaped so that it has a single sealing lip and preferably made of a combination of plastic materials such as high molecular weight PE and PEEK, and fitted with an energising ring made of an elastomer.

The first self-energising seal and a bearing assembly 23 face one another and are respectively closed upstream of the first self-energising seal 22 by the shoulder 20 and downstream of the bearing assembly 23 by the projection 13 on the locking flange 10. The projection 13 is used to centre the PEEK bushing 15 relative to the housing flange 9.

The bearing assembly 23 is made of special non-galling stainless steel, preferably Nitronic 60, and is coaxial with and alongside the first self-energising seal 22 and equipped with a system for extraction from its housing such as a suitably sized thread.

The second widening of the cross-section 19 houses a second static seal unit 24 having a second self-energising seal 25 (with dimensions and geometry allowing containment of the very high pressures and preferably made of polyurethane with Shore hardness 90-98), blocked upstream of it by the surface of the block 7 and downstream of it by the shoulder 20. The seal 25 does not make contact with the plunger 5 and is designed to contain the pressurised fluid between the block 7 and the chamber 6; it may also be fitted with an external anti-extrusion ring 39.

The numeral 26 denotes a block consisting of two half-parts or plates 26*a* and 26*b* rigidly clamped to one another by fixing means, preferably stud bolts not illustrated in FIG. 1.

The insides of the two plates 26*a* and 26*b* have been machined to make grooves in them designed to house an internal manifold 27, preferably having a hemispherical shape, connecting the compression chamber 6 and a non-return intake valve 28 and a non-return delivery valve 29 housed in containers 30 inserted between the central blocks 26 and respectively the delivery manifold 40 and the lower support flanges 41.

The block 26 may also consist of a single piece, directly worked with a machine tool to create the channels 31 and 32 and the manifold hole 27 opposite the rear surface of the block 26.

The non-return intake valve 28 is connected to the internal manifold 27 by the channel 31 which forms an intake pipe and the non-return delivery valve 29 is connected to the internal manifold 27 by the channel 32 which forms a delivery pipe.

The intake pipe and delivery pipe are arranged in such a way that they are specular with one another relative to a horizontal plane passing through the axis of the pumping chamber 6 and set at an angle $\alpha$ to the normal to said horizontal plane which varies from 45 to 62 degrees, preferably 56 degrees.

Advantageously, the internal surfaces of the manifold 27 and of the intake and delivery pipes 31 and 32, exposed to the pressure of the fluid, are treated by polishing, radiusing of any edges on the intersections of concurrent holes, micro shot peening and electropolishing.

Figure 4:
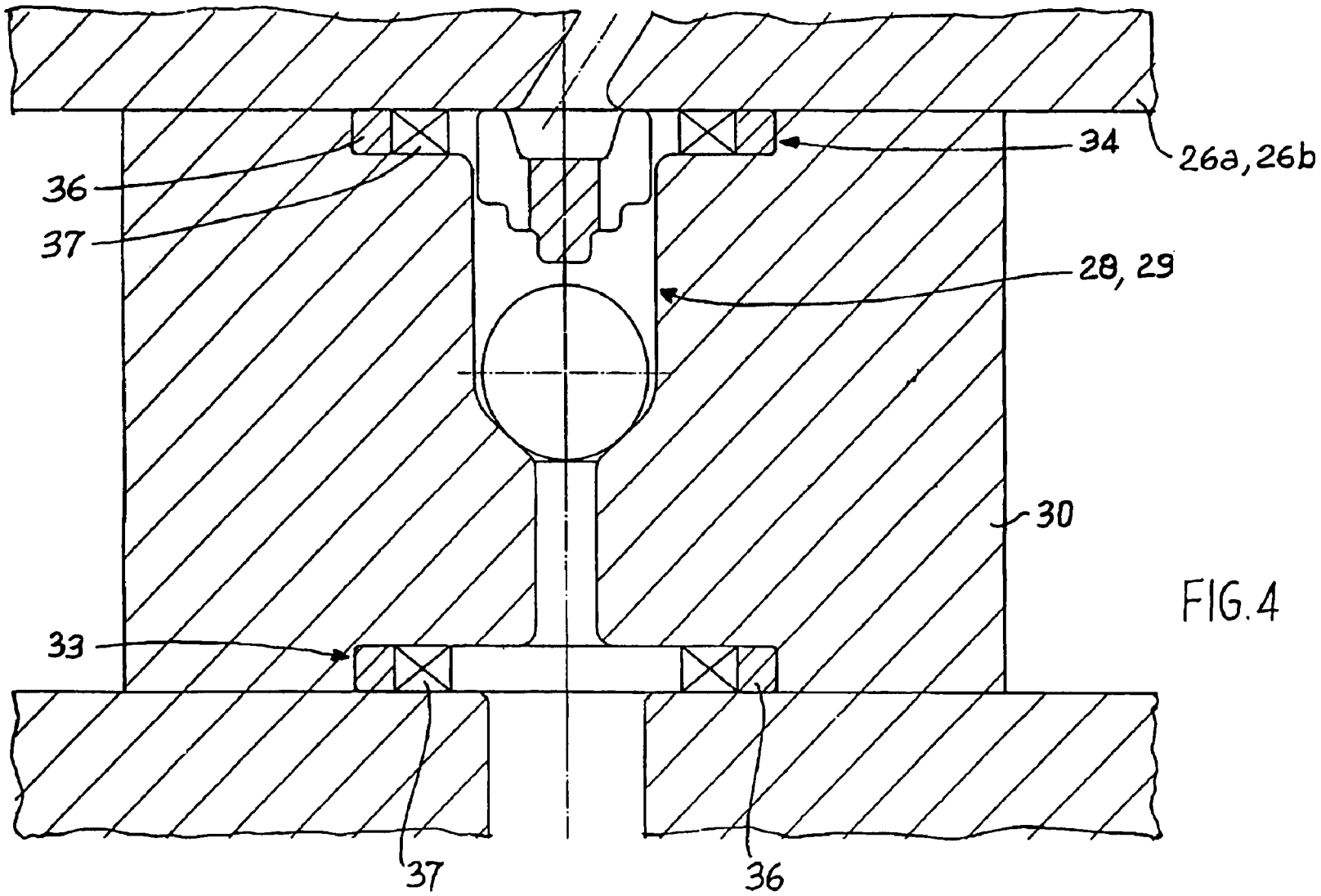
FIG. 4 is a side view and enlarged cross-section at mid length of a non-return delivery valve.

For each non-return valve 28, 29, hollows are made close to the upper and lower surfaces of the valve containers 30, respectively a first hollow 33 upstream of the non-return valve and a second hollow 34 downstream of it (FIG. 4).

Said hollows 33, 34 are designed to accommodate a third static seal unit 35 having an anti-extrusion ring 36, preferably a circular ring with a rectangular cross-section, inside which a third self-energising seal 37 is fitted.

Figure 3:
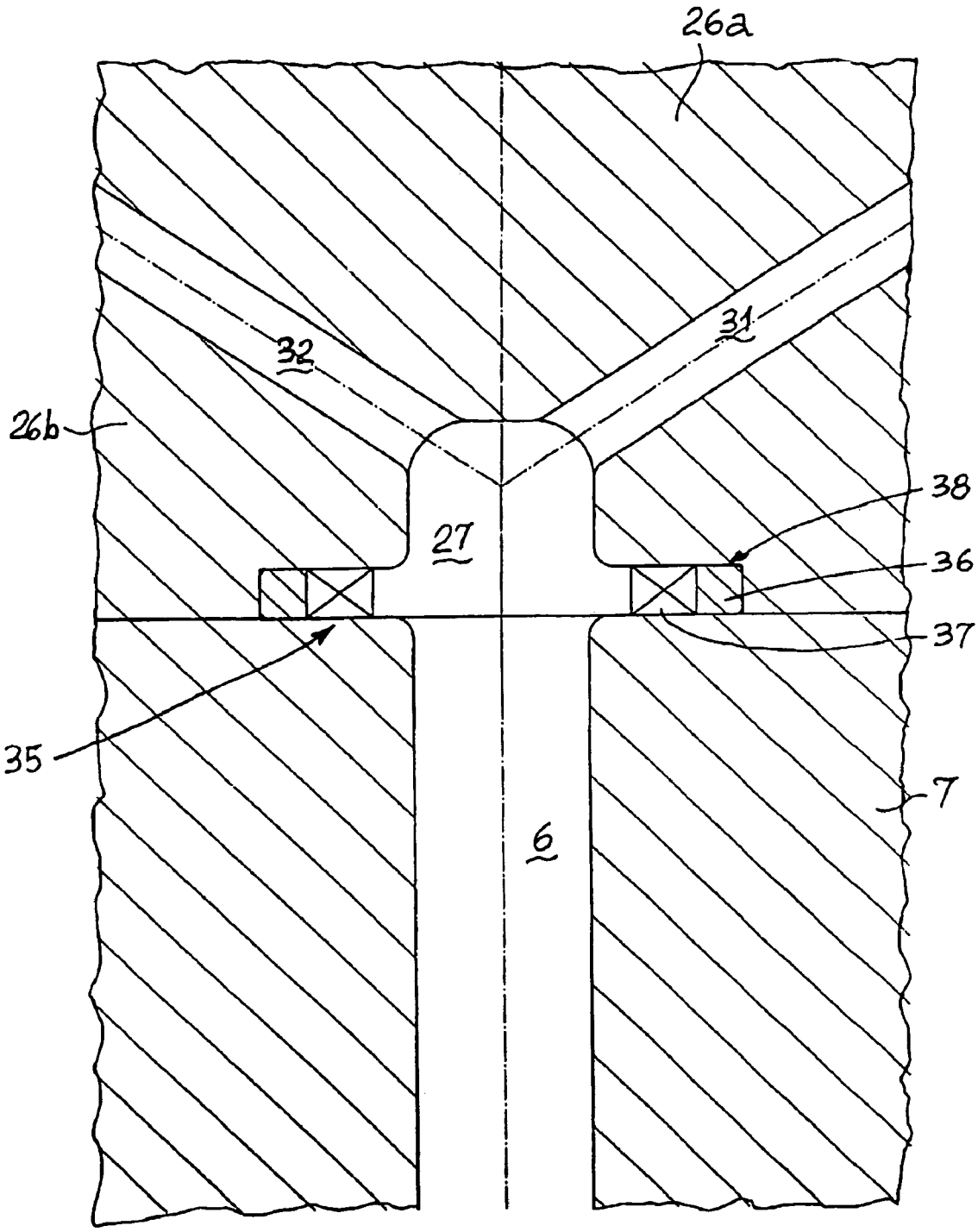
FIG. 3 is a side view and enlarged cross-section at mid length of the manifold connecting the compression chamber and the valves.

Said third static seal unit 35 is also inserted, by means of a third hollow 38, close to the internal manifold 27, more precisely at the intersection between the manifold and the compression chamber 6 (FIG. 3).

The third static seal unit 35 has one end closed by the block 7 and the opposite end contained in a widening of the cross-section of the internal manifold 27.

Each anti-extrusion ring 36 is shaped in such a way as to create an interference fit with the height of the respective hollow 33, 34, 38, preferably by 0.1 mm, so that, during assembly, the ring forms a mechanical seal on the hollow and at the same time guarantees correct self-energising seal 37 preloading.

The numeral 40 denotes a delivery manifold connecting the two or more delivery valve 29 units, whilst 41 denotes a support flange for the intake valve 28 unit for each plunger connected to the pump intake manifold.

The invention claimed is:

1. A homogeniser for continuous treatment of fluids at very high pressure, comprising:

at least one single-acting plunger with reciprocating motion from a guide chamber to a compression chamber from a fluid intake position to a fluid delivery position;

a plunger block for each said plunger, connecting the compression chamber with at least one intake valve and with at least one delivery valve for each said plunger;

an internal manifold connecting the compression chamber with the at least one intake valve and the at least one delivery valve;

at least one intake pipe and at least one delivery pipe both communicating with the manifold and respectively terminating in the intake valve and in the delivery valve, wherein the at least one intake valve and the at least one delivery valve are housed in separate containers fixed to the plunger block, and the homogeniser comprises at least one of the following units:

a first, dynamic seal unit positioned around the guide chamber and in contact with a surface of the plunger, designed to create a seal on the plunger during compression;

a second, static seal unit located close to an intersection between the compression chamber and the guide chamber, designed to contain pressure generated during compression between opposite surfaces of a compression chamber block and a housing flange for a dynamic seal;

a third, static seal unit located upstream and downstream of each said at least one intake valve and said at least one delivery valve and at an intersection between the manifold and the compression chamber, respectively housed in hollows designed to prevent fluid from escaping.

2. The homogeniser according to claim 1, wherein the first, dynamic seal unit comprises:

at least one first self-energising seal with an energising ring made of an elastomer;

at least one bearing assembly, coaxial with and alongside the first self-energising seal and equipped with a system for extraction from its housing.

3. The homogeniser according to claim 2, wherein the first self-energising seal comprises a single sealing lip and is made of a combination of plastic materials, high molecular weight PE and PEEK.

4. The homogeniser according to claim 2, wherein the bearing assembly is made of non-galling stainless steel.

5. The homogeniser according to claim 4, wherein said non-galling stainless steel is UNS S21800.

6. The homogeniser according to claim 2, wherein the second seal unit comprises a second self-energising static seal with dimensions and geometry which allow containment of very high pressures.

7. The homogeniser according to claim 6, wherein the second self-energising static seal is fitted with an external anti-extrusion ring.

8. The homogeniser according to claim 2, wherein said system for extraction comprises a thread.

9. The homogeniser according to claim 1, wherein the third seal unit comprises:

at least one anti-extrusion ring with a rectangular cross-section and a circular ring cross-section in a direction orthogonal to an axis of symmetry;

at least a third self-energising seal inside a respective anti-extrusion ring.

10. The homogeniser according to claim 9, wherein each anti-extrusion ring is mounted to create an interference fit with the height of each of the hollows for a more effective mechanical seal.

11. The homogeniser according to claim 10, wherein the interference fit of each anti-extrusion ring is equal to 0.1 mm on the height of the hollow in which the ring is housed.

12. The homogeniser according to claim 1, wherein the internal surfaces of the manifold, the intake pipe and the delivery pipe, exposed to the pressure of the fluid, are treated by manual polishing, radiusing of any edges at the intersections of concurrent holes, micro shot peening and electropolishing.

13. The homogeniser according to claim 1, wherein the plunger is made of a ceramic material.

14. The homogeniser according to claim 13, wherein said ceramic material is pure silicon nitride, $SbN_4$.

15. The homogeniser according to claim 1, wherein a plunger seal apparatus is present, housed in the guide chamber and locked by a locking flange outside the compression chamber contained in the compression chamber block.

16. The homogeniser according to claim 1, wherein a lubricating coolant fluid feed channel is positioned on a locking flange immediately axially close to a first, dynamic seal unit.

17. The homogeniser according to claim 1, wherein the plunger comprises a guide consisting of a bushing housed in a locking flange and centered relative to said housing flange by a concentric centring projection.

18. The homogeniser according to claim 17, wherein the housing flange is centered relative to the compression chamber block by cylindrical pins.

19. The homogeniser according to claim 1, wherein the at least one delivery valve includes a plurality of delivery valve units connected by a delivery manifold.

20. The homogeniser according to claim 1, wherein a support flange for the intake valve unit for each plunger is connected to a low pressure intake manifold.

21. The homogeniser according to claim 1, wherein each third, static seal unit consists of a self-energising seal and an anti-extrusion ring and can be applied to all of the high pressure seal zones including a connection between the manifold and a homogenising valve.

22. The homogeniser according to claim 1, said homogeniser being equipped with an adjustable homogenising valve installed at an outlet of a delivery manifold.

* * * * *

UNITED STATES PATENT AND TRADEMARK OFFICE

CERTIFICATE OF CORRECTION

PATENT NO. : 7,661,873 B2
APPLICATION NO. : 10/594362
DATED : February 16, 2010
INVENTOR(S) : Marco Gandini et al.

It is certified that error appears in the above-identified patent and that said Letters Patent is hereby corrected as shown below:

On the Title Page, Item (73)
The correct name of the Assignee is GEA NIRO SOAVI S.P.A.

Signed and Sealed this
Twenty-second Day of March, 2011

David J. Kappos

David J. Kappos
*Director of the United States Patent and Trademark Office*